United States Patent [19]

Randolph

[11] 4,131,277

[45] Dec. 26, 1978

[54] BOWLING BALL

[76] Inventor: John L. Randolph, 1076 N. Jacoby Rd., Akron, Ohio 44321

[21] Appl. No.: 850,915

[22] Filed: Nov. 14, 1977

[51] Int. Cl.[2] ..... A63B 37/14

[52] U.S. Cl. ..... 273/63 D; 273/63 E; 273/63 G; 264/254; 264/255; 428/218; 428/480

[58] Field of Search ..... 273/63 R, 63 G, 63 E, 273/63 D; 264/251, 254, 255; 428/218, 480, 482

[56] References Cited

U.S. PATENT DOCUMENTS

| | | | |
|---|---|---|---|
| 3,206,201 | 9/1965 | Hendricks | 273/63R |
| 3,248,113 | 4/1966 | Baggenstoss et al. | 273/63 R |
| 3,256,018 | 6/1966 | Baggenstoss | 273/63 R |
| 3,350,252 | 10/1967 | Twickler | 264/254 |
| 3,703,571 | 11/1972 | Roberts | 264/255 |
| 3,865,369 | 2/1975 | Randolph | 273/63 E |

*Primary Examiner*—William J. Van Balen
*Attorney, Agent, or Firm*—Harold S. Meyer

[57] ABSTRACT

A bowling ball has a surface made from a material containing a minor quantity of functionally terminated liquid elastomer combined with a major quantity of resin-forming material reactive with the functional end groups of the elastomer, and has a greatly enhanced coefficient of friction against ordinary bowling lane surfaces, permitting superior control of the path of the ball and therefore better scores by the bowler. Such surface compositions are preferably made from a liquid polyester resin of the type which is hardenable by a peroxide, with addition of a liquid vinyl-terminated diene polymer or copolymer in a quantity amounting to about 10% to 35% of the mixture.

10 Claims, 6 Drawing Figures

BOWLING BALL

BACKGROUND

Bowling balls in recent years have been made from or surfaced with ebonite (rubber vulcanized with enough sulfur to make it quite hard) or from any of a variety of synthetic resins such as phenolic resins, epoxy resins, or polyester resins. Such balls are strong and durable but have a slick surface which causes them to slide for a considerable distance before undergoing true rolling, and are not easily induced to enter the "pocket" of the array of ten pins so as to cause a strike, in which all of the pins are tumbled.

It is known that better control, and better scores, can be obtained by altering either the surface of the bowling lanes, or of the balls, by application of temporary coatings, such as oil on the lanes, or softeners on the balls, or by making the balls with a surface containing gritty materials. Such expedients have either not appealed to the majority of bowlers or have been restricted by the rules of bowlers' organizations, such as hardness specifications for the surface of bowling balls.

OBJECTS

The primary object of this invention is to provide bowling balls which have a satisfactory and permissable surface hardness, yet exhibit an improved frictional engagement with the surface of bowling lanes, so as to enhance the ability of the bowler to achieve high scores, without having an objectionable gritty surface.

Another object is to provide a process for making bowling balls having an improved frictional engagement with the bowling lanes.

SUMMARY OF THE INVENTION

This invention is a bowling ball, and a method for making it, which involves provision of a surface layer on the ball of a composition which is firm and which complies with the hardness requirements for bowling balls, yet has a high coefficient of friction with the wood surface of bowling lanes, even in the presence of significant coatings of wax or oil, without damaging the surface of the lanes.

The new surfacing composition provided for the bowling balls consists of a mixture of a functionally terminated type of liquid rubber blended with a considerably greater quantity of liquid resin hardenable by a chemical reaction. When the mixture is hardened, at least two changes occur. One is the setting of the liquid resin material to form a hard matrix. The other is the conversion of the liquid rubber to an elastomer by chain lengthening, with segregation of elastomer material in microscopic domains which are chemically bonded to the surrounding matrix. The consequence of these occurrences is that the material, when it is completely set, is somewhat less hard than would be the case in the absence of the liquid rubber ingredient, but is not softened to the same extent as would be the case if a conventional liquid softener were added. More importantly, the presence of the elastomer domains produces a great change in the surface characteristics of the material.

Consequently, the finished bowling ball, when the molding surface is removed by the usual finishing operation of grinding to an exact spherical shape of the prescribed standard size, has frictional properties which are significantly different from those of homogeneous resin materials not containing the liquid rubber additive.

The result is that bowling balls which have a surface made of this particular composition have the capacity to make frictional rolling contact with the surface of the bowling alley at a much earlier distance than is possible with conventional balls. This gives the bowler a significantly greater measure of control over the trajectory of the ball so that he can cause it to swerve from straight line rolling for effective controlled directional impact with the pins so as to permit a bowler to achieve higher scores than with bowling balls surfaced with conventional materials.

THE DRAWINGS

In the accompanying drawings, FIG. 1 shows the manner in which a segment of either heavier or lighter density material than the surface material is cast in the bottom of a hemispherical mold, and FIG. 2 shows the manner in which such a spherical segment is located in a larger spherical mold for casting of a bowling ball consisting of two different portions of different density, for use by bowlers having different requirements.

SPECIFIC DESCRIPTION

Figure 1:
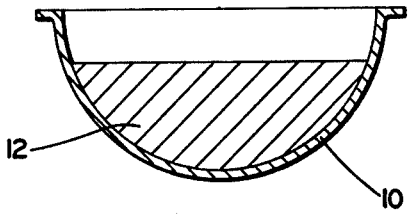

The novel feature of the bowling balls of this invention is the character of the material at the surface of the ball. The major part of this material can consist of any kind of synthetic resin which is hard and impact-resistant and can conveniently be cast from a liquid condition. The surfacing composition can therefore be any of a considerable variety of types of synthetic resins obtainable in a liquid intermediate form, such as phenolic resins, amine formaldehyde resins, epoxy resins, polyurethane resins, or polyester resins.

In each case, the liquid resin which is to be cast is mixed with a small proportion of a functionally terminated liquid elastomer.

Functionally terminated liquid elastomers are materials of moderate molecular weight which are essentially non-volatile liquids, the molecular structure of which is essentially linear but non-crystallizable, so that when the functionally reactive end groups are linked, the molecules are joined end to end to increase the molecular weight from that of a liquid to the considerably greater value of a solid which will exhibit the characteristic elastic extensibility of rubber and will then be a true elastomer.

Such materials can be made from any of the usual base materials which can be polymerized to form synthetic elastomers, such as the dienes (butadiene, isoprene, chloroprene) alone or mixed with minor proportions of other polymerizable compounds which are at least partly olefinic, including hydrocarbons (such as isobutene or styrene) or olefinic acids or esters (such as acrylic or maleic acid, or ethyl acrylate or diethyl maleate), or acrylonitrile; or can be made from tetrahydrofurane; or can be made from epichlorhydrin; or can be made from polyalkylene polysulfides; and the like.

All of these elastomer-producing monomers and many others can be converted into polymers with functional end groups such as hydroxyl and especially phenolic hydroxyl, or mercapto, or carboxyl, or epoxy, or amino, or urea, by well known techniques such as by use of polymerization catalysts which lead directly or indirectly to the desired functional end group, or by terminating polymerization at the desired polymer molecular weight by a material which converts the polymer forming radical to a different functional radical. In each case, the polymerization is carried only to the extent of producing a liquid but essentially non-volatile polymer which can be blended in liquid form with a different liquid material or mixture capable of setting to a hard, strong, impact-resistant resin.

An important feature of this invention is that the liquid elastomer must have functional end groups which are reactive with the base resin under the hardening conditions chosen in a particular instance. Thus, for use with a phenolic resin hardened with a formaldehyde donor, a phenol terminated liquid polymer of a diene alone or of a diene with some styrene would be suitable. For use with a hard polyurethane mix, an amide terminated liquid polymer can be produced by reaction of a carboxyl terminated polymer with an amine to produce terminal amide groups. For use with an epoxy resin, an amine terminated liquid rubber can be used. For use with an olefinically unsaturated resin such as a polyester containing maleic acid or fumaric acid rests, a vinyl terminated liquid rubber can be used. In each case the reaction conditions including catalysts for setting of the mixture should be such as to harden the base resin and at the same time link the functional end groups of the liquid rubber to the base resin.

The functionally terminated elastomer constituent should be one which is at least somewhat soluble in the resin base, and preferably completely miscible with it in the original liquid condition of the base resin. It should also have a limited solubility in the set or solidfied condition. The consequence is that the functionally terminated elastomer in its original liquid condition is easily mixed with the resin base, but in the set condition is present as minute elastomeric domains.

Each type of hardenable liquid resin requires some particular kind or kinds of setting agent. Thus phenolic resins require addition of formaldehyde or some other aldehyde or aldehyde donor. Epoxy resins require addition of a material reactive with the epoxy groups, such as an amine. Polyester resins generally contain reactive ethylenic double bonds from incorporation of maleic or fumaric acid along with phthalic acid or an aliphatic dicarboxylic acid when the polyester material is made, and are hardened by a polymerization catalyst such as a per-oxygen compound.

Accordingly, the functionally terminated elastomer which is used must be one which has terminal groups which will be caused to link the elastomer to the resin during the course of hardening of the resin, or to put the matter another way, the hardening or setting material for the resin must also be capable of bringing about a linking reaction between the resin and the terminal groups of the liquid elastomer.

There are enough different kinds of liquid materials convertible to hard resins, and of hardening agents for them, that a great many different specific combinations are possible. For each kind of hard resin, a functionally terminated liquid elastomer is chosen in accordance with this invention to be easily miscible with the resin before it is solidified, and to be reactive under the same conditions as are adopted for hardening the base resin.

The proportion of functionally terminated liquid elastomer is determined in large part by the hardness desired in the finished ball. For balls of the minimum hardness permitted in tournament play, the liquid elastomer can be from 5% to about 30% of the total composition, but even higher proportions can be used if a softer surface is desired and permitted.

As a specific example of the presently preferred manufacturing procedure and resulting product, a polyester ball is made in the manner shown in FIGS. 1, 2, and 3, as follows:

A hemispherical dish 10 shown in FIG. 1, of a diameter about two-thirds of that of the finished ball, is used to produce a core 12 of light-density or heavy-density material composed of the same type of polyester which is to be used in making the surface of the ball. This may be a conventional liquid polyester such as the product of the reaction of diethylene glycol with a mixture of phthalic acid (or anhydride) with a little maleic acid (or anhydride). The liquid polyester is mixed with a granular or powdered material of low density such as sawdust, granules of cork, or microballoons of glass or of phenolic or other types of resin, in an appropriate proportion for making a ball of a finished weight lighter than pure polyester when the core is embedded inside of the ball; or a material of high density such as barium sulfate or iron oxide or lead oxide pigment for making a ball heavier than pure polyester. The mix of polyester and light or heavyweight material, with a small quantity of methyl ethyl ketone peroxide (catalyst) and a still smaller quantity of cobalt naphthenate solution (accelerator), is poured into the dish and allowed to set.

Figure 2:
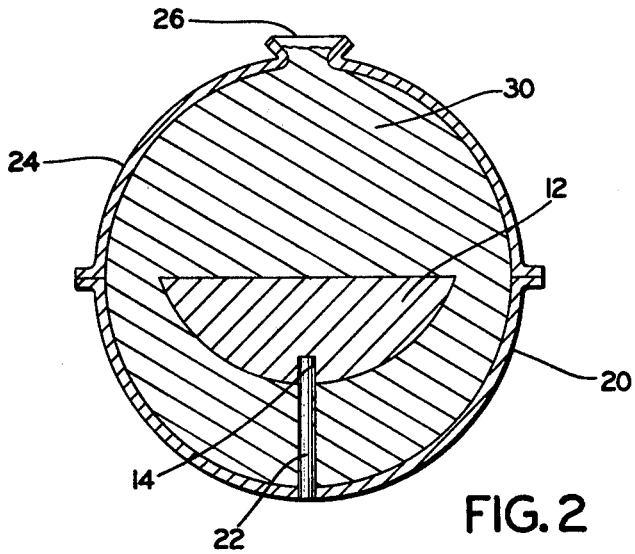
Figure 3:
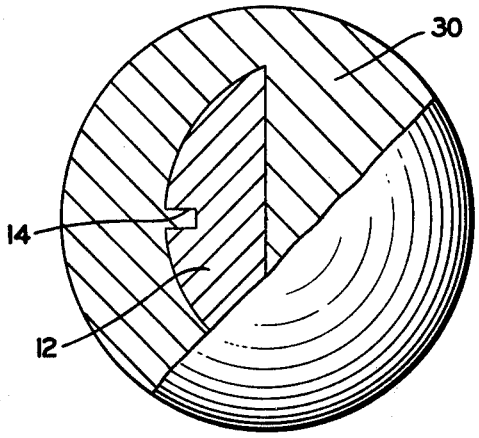
FIG. 3 is a partial section through a finished bowling ball showing a segment of a plastic material of either especially heavy or especially light material surrounded by a cast surface layer.

The core 12 so produced is then removed from the dish 10 and a hole is drilled in the curved surface to such a depth that when the core 12 is placed in the bottom hemispherical half 20 of a bowling ball mold, on internally projecting pin 22, as shown in FIG. 2, the plane surface of core 12 will be approximately level with the margin of mold half 20 so that the plane surface will be about in the midplane of the finished ball.

The top mold half 24 having a filling opening 26 is placed on bottom mold half 20 with the core 12 in place, and a liquid polyester mix is introduced through filler opening 26 to fill the mold and is allowed to set to form the surface material 30 of the ball. When the mix has set, the ball is removed from the mold, and the hole produced by pin 22 is filled by a small quantity of the same material used for the main portion 30 of the ball and is allowed to set. The neck which was formed at the filler opening is cut off, and the ball is ground to a spherical surface of the prescribed diameter. It then contains a slightly off-center core, as shown in FIG. 3, with a density differing from that of the main portion of the ball, to compensate at least in part for the removal of material when the finger holes are drilled.

The polyester mix constituting the major part of the ball and particularly the surface 30 of the ball can be primarily the same material as the core 12 (without the filler) and have as its principal constituent a liquid polyester made from diethylene glycol, phthalic anhydride, and maleic anhydride. To the polyester is added a minor proportion of vinyl terminated liquid rubber made from butadiene (about two-thirds) and acrylonitrile (about one-third) which is a commercial material sold by B. F.

Goodrich Chemical Co. as VTBN meaning Vinyl Terminated Butadiene Nitrile polymer. It is sometimes preferred to use a mixture of hard polyester with a little soft polyester, together with the functionally terminated liquid rubber.

Specifically, a composition is made containing a liquid polyester and a light filler, along with a peroxide catalyst, and a segment of a sphere 12 is cast in the manner described above. It is supported on a pin 22 in a spherical half mold 20 as shown in FIG. 2, and the top half mold 24 is fastened in place. The mold is then filled with the following composition in parts by weight:

| | |
|---|---|
| Hard polyester resin | 700 |
| VTBN | 300 |
| Methyl ethyl ketone peroxide | 13 |
| Cobalt naphthenate 6% solution | 2 |

This mix gels in about an hour and becomes quite firm in a few hours. The ball so made is removed from the mold and is finished by grinding to an accurate spherical shape in the usual way. It has a Shore Durometer hardness of about 75 on the D scale, and a total weight depending on the quantity of light filler used in the core 12.

If the finger holes are drilled at the location of the filling opening of the mold, and a lightweight core is used, the ball will have a top weight resulting from the off-center location of the core in the ball. If the finger holes are drilled in a location corresponding to the joint in the mold, the ball will have a side weight of the same magnitude.

When the ball is used in actual play on a bowling alley, it is found that the ball commences rolling (rather than sliding) much sooner after delivery by the player than previously known balls of comparable hardness. This permits the player to deliver the ball so as to approach the pocket between the leading pins from a better angle than could be done with previously known balls of comparable hardness, and therefore to achieve significantly higher scores than with the slick surface balls which have previously been considered to be the best available.

Figure 4:
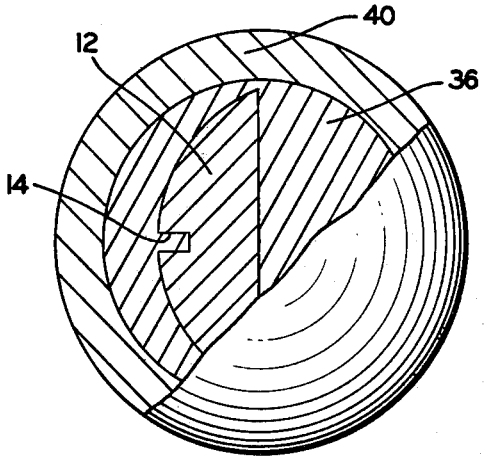
FIG. 4 is a partial section of a bowling ball of the same construction as FIG. 3 but with an added surface layer of a different composition.

If desired, the balls can be made initially undersize by using spherical molds of a smaller diameter than that of a finished bowling ball, to produce a center of reduced diameter enclosed in a surface veneer, as shown in FIG. 4. The spherical center may consist of a core 12 of appropriate density, size, and shape for a ball of a desired finished weight with a particular magnitude of top weight or side weight, embedded in an intermediate diameter sphere 36 of any desired type of moldable material. This sphere 36 is then centered in a finish mold and the surfacing material 40, which may be of the same composition as the surface portion 30 described above, is cast around it. Such a multilayer ball can be made largely of somewhat less expensive material than the balls which are of the same kind of high quality material throughout, or can have different layers of different materials for other functional reasons.

As is known to expert bowlers, the shape and location of the massive parts of a ball have an important influence on performance.

In my prior U.S. Pat. No. 3,865,369 I showed how the performance of a ball could be altered by making a weighted core or insert in such a shape that a major part of its mass is close to the surface so as to enhance the moment of inertia of the ball. The skilled bowler using such a ball can hold and deliver it so as to impart an original rotation which will persist through a major part of the travel of the ball and affect its path in a desirable way in travelling toward the pins. The opposite effect can also be attained by making such a core of lighter material than that which surrounds it, to reduce the moment of inertia of the ball, so that the rotation unavoidably imparted by the bowler will not persist undesirably and prevent high scores from being achieved by a bowler accustomed to a different type of delivery.

Because of the subtle and often unrecognized differences in delivery by different bowlers, balls of slightly different construction will be chosen by different bowlers because the bowlers learn that different balls permit each to achieve better scores than if they all used identical balls.

Figure 5:
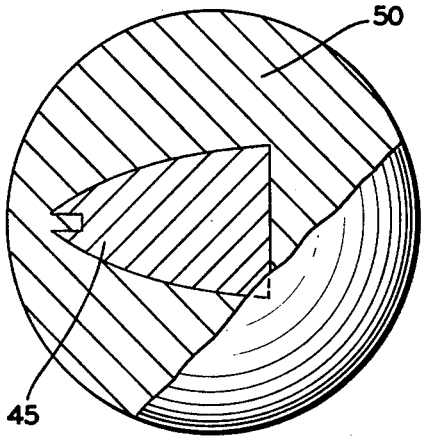
FIG. 5 is a partial section of a bowling ball in which the insert is of a different shape for a special purpose.
Figure 6:
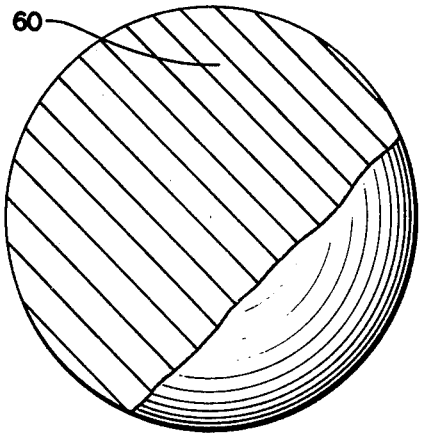
FIG. 6 is a partial section through a bowling ball made of the same material throughout.

I have accordingly made balls of differing constructions, some of which have a top weight or side weight concentrated near the center of the ball, to minimize the moment of inertia of the ball. Such an internal weight of low moment of inertia is conveniently made in the approximate shape of a paraboloid, which somewhat resembles an ogival or bullet shape as shown at 45 in FIG. 5, since the same casting mold can then be used in making cores of considerably different volume in order to vary the total weight, or to increase or decrease the moment of inertia of the various balls, to meet the desires or needs of particular bowlers. In balls so made, the core 45 can be either heavier or lighter than the material 50 of the surrounding sphere, depending on whether a high or low moment of inertia is desired, and the size of the core 45 can be varied to produce a finished ball of the total weight desired by the user.

The material 50 surrounding the core 45 can be made of the composition containing a functionally terminated liquid rubber as described above, so that the material 50 will be at the surface and perform the primary function of this invention, of providing a high friction with the surface of the bowling lane.

On the other hand, the material 50 surrounding the core 45 can be formed to have a smaller diameter, and can be made of almost any moldable material of sufficient strength and appropriate density, and be surrounded by a cover or veneer containing a minor proportion of functionally terminated liquid rubber as described above.

A specific example has been given of a surface composition of a bowling ball composed of hard polyester resin 70% and a vinyl terminated liquid elastomer 30%. This composition has a Durometer hardness of about 75 and is within the range of hardness currently permitted for tournament play. If a harder ball is desired or required, the proportion of elastomer can be reduced. If the ball is not used in tournament play, a larger proportion may be used. Generally from about 5% to 40% in a hard matrix will give desirable improvements in performance of the balls.

Moreover, the firmness or hardness of the matrix material can be altered by choice of a different base material, or by blending a hard resin with a soft resin and incorporating the functionally terminated liquid elastomer with the modified resin. Thus results almost the same as those described above can be obtained by mixing 70% hard polyester resin and 10% soft polyester resin with 20% vinyl terminated liquid elastomer.

Similar results are obtainable by using other types of hard, impact resistant, castable resins together with functionally terminated liquid elastomers which will be caused to set by the same influence which will set the base resin. Thus an epoxy composition which will set to a hard resin can be blended with amine terminated liquid elastomer in the proportions indicated above, to produce balls with a high coefficient of friction which will have the same superior properties. As another example, a polyurethane composition which will set to a hard resin can be similarly blended with an amine terminated or mercapto terminated liquid elastomer with the same results.

Although the invention has been specifically described in a variety of physical forms and arrangements, with primary reference to one particular kind of castable resin, containing a specific functionally terminated liquid elastomer, it is evident that the principles of the invention can be carried out with almost any castable resin of sufficient strength and resistance to impact, together with any functionally terminated liquid elastomer which is miscible with the resin and can be caused to set by the same influence which causes the resin to set.

I claim:

1. A bowling ball, the surface of which is composed of a matrix of hard, strong resin resistant to impact, containing domains of elastomeric material chemically bonded to the surrounding matrix.

2. A ball as in claim 1, in which the matrix is 60% to 95% of the surface material and the elastomer domains are 5% to 40%.

3. A ball as in claim 1 in which the matrix is a polyester resin and the domains of elastomeric material are bonded to the matrix by vinyl groups.

4. A ball as in claim 3 in which the surface is the set product of the catalyzed reaction of a major proportion of an unsaturated polyester resin and a minor proportion of a vinyl terminated liquid elastomer.

5. A ball as in claim 1, containing a core of a different density from that of the surface material.

6. A ball as in claim 5, in which the core has a shape rounded at one end and flat at the other.

7. A process of making a bowling ball of high hardness and high coefficient of friction which comprises mixing a liquid settable to a hard resin resistant to impact, with a functionally terminated liquid elastomer settable under the same influence, which materials are at least partially mutually soluble, and causing the mixture to set on the surface of a bowling ball.

8. A process as in claim 7 in which the liquid settable to a hard resin is an unsaturated polyester, and the liquid elastomer is vinyl terminated.

9. A process as in claim 8 in which the polyester is 60% to 95% of the mix and the liquid elastomer is 5% to 40% of the mix.

10. A process as in claim 9 in which the set surface material is reduced to an accurate spherical shape.

* * * * *